US009620081B2

(12) United States Patent
Tripathi et al.

(10) Patent No.: US 9,620,081 B2
(45) Date of Patent: Apr. 11, 2017

(54) HARDWARE AUXILIARY CHANNEL FOR SYNCHRONOUS BACKLIGHT UPDATE

(71) Applicant: Apple Inc., Cupertino, CA (US)

(72) Inventors: Brijesh Tripathi, Los Altos, CA (US); Peter F. Holland, Los Gatos, CA (US); Marc Albrecht, San Francisco, CA (US); Christopher P. Tann, San Jose, CA (US)

(73) Assignee: Apple Inc., Cupertino, CA (US)

( * ) Notice: Subject to any disclaimer, the term of this patent is extended or adjusted under 35 U.S.C. 154(b) by 154 days.

(21) Appl. No.: 14/477,454

(22) Filed: Sep. 4, 2014

(65) Prior Publication Data

US 2016/0071485 A1 Mar. 10, 2016

(51) Int. Cl.

| | |
|---|---|
| ***G09G 5/10*** | (2006.01) |
| ***G09G 5/36*** | (2006.01) |
| *G09G 3/20* | (2006.01) |
| *G09G 3/34* | (2006.01) |
| *G09G 5/12* | (2006.01) |

(52) U.S. Cl.

CPC ..... *G09G 5/10* (2013.01); *G09G 5/36* (2013.01); *G09G 3/2044* (2013.01); *G09G 3/3406* (2013.01); *G09G 5/12* (2013.01); *G09G 2320/0646* (2013.01); *G09G 2330/021* (2013.01); *G09G 2340/10* (2013.01); *G09G 2360/144* (2013.01); *G09G 2370/04* (2013.01)

(58) Field of Classification Search

CPC ..... G09G 3/34; G09G 3/3413; G09G 3/3233; G09G 3/3241; G09G 3/3258; G09G 5/02; G09G 2320/0276; G09G 2320/0626; H04N 1/60; G06F 13/1605; G06F 13/1615; G06F 13/4022; G06F 2207/4812

See application file for complete search history.

(56) References Cited

U.S. PATENT DOCUMENTS

| | | | | |
|---|---|---|---|---|
| 7,352,410 | B2 | 4/2008 | Chou | |
| 7,960,682 | B2 | 6/2011 | Gardner, Jr. | |
| 8,305,401 | B1 | 11/2012 | Lie | |
| 2007/0176870 | A1 | 8/2007 | Hung et al. | |
| 2014/0021868 | A1* | 1/2014 | Cho | G09G 5/10 315/158 |
| 2014/0132158 | A1 | 5/2014 | Land et al. | |

* cited by examiner

*Primary Examiner* — Antonion A Caschera

(74) *Attorney, Agent, or Firm* — Rory D. Rankin; Meyertons, Hood, Kivlin, Kowert & Goetzel, P.C.

(57) ABSTRACT

Systems, apparatuses, and methods for synchronizing backlight adjustments to frame updates in a display pipeline. A change in the ambient light is detected and as a result, backlight settings are adjusted. To offset a reduction in the backlight, the color intensity in the frames is increased. While the change in ambient light is detected asynchronously, the adjustment to the backlight settings and color intensity is synchronized to a frame update via a virtual channel for the auxiliary channel of the display interface.

20 Claims, 10 Drawing Sheets

HARDWARE AUXILIARY CHANNEL FOR SYNCHRONOUS BACKLIGHT UPDATE

BACKGROUND

Technical Field

Embodiments described herein relate to displays, and more particularly, to performing synchronous backlight updates on a display.

Description of the Related Art

Part of the operation of many computer systems, including portable digital devices such as mobile phones, notebook computers and the like, is the use of some type of display device, such as a liquid crystal display (LCD), to display images, video information/streams, and data. Accordingly, these systems typically incorporate functionality for generating images and data, including video information, which are subsequently output to the display device. Such devices typically include video graphics circuitry to process images and video information for subsequent display.

In digital imaging, the smallest item of information in an image is called a "picture element", more generally referred to as a "pixel." For convenience, pixels are generally arranged in a regular two-dimensional grid. By using this arrangement, many common operations can be implemented by uniformly applying the same operation to each pixel independently. Since each pixel is an elemental part of a digital image, a greater number of pixels can provide a more accurate representation of the digital image. To represent a specific color on an electronic display, each pixel may have three values, one each for the amounts of red, green, and blue present in the desired color. Some formats for electronic displays may also include a fourth value, called alpha, which represents the transparency of the pixel. This format is commonly referred to as ARGB or RGBA. Another format for representing pixel color is YCbCr, where Y corresponds to the luma, or brightness, of a pixel and Cb and Cr correspond to two color-difference chrominance components, representing the blue-difference (Cb) and red-difference (Cr).

Most images and video information displayed on display devices such as LCD screens are interpreted as a succession of image frames, or frames for short. While generally a frame is one of the many still images that make up a complete moving picture or video stream, a frame can also be interpreted more broadly as simply a still image displayed on a digital (discrete, or progressive scan) display. A frame typically consists of a specified number of pixels according to the resolution of the image/video frame. Most graphics systems use frame buffers to store the pixels for image and video frame information.

Often, the primary draw of battery power of a portable device is the display device and, in particular, the backlight, which can be used to illuminate the display device. The backlight may provide a background light or color over which text, pictures and/or images are displayed. Displays with backlights (e.g., LCDs) are widely used in mobile devices and provide excellent viewing indoors. However, when used outside, ambient light may reflect off the surface of the display, thereby making it difficult to view the display in high ambient light conditions. Accordingly, techniques for adjusting the backlight are needed in response to changes in the viewing environment to provide for optimal viewing conditions for the user.

SUMMARY

Systems and methods for updating display brightness synchronously with frame updates are disclosed.

In various embodiments, frames may be processed by a display pipeline and presented on a respective display screen. The display pipeline may include one or more internal pixel-processing pipelines for processing the frame data received from the memory controller for a respective video source. The display pipeline may be coupled to an ambient light sensor and a backlight controller. In one embodiment, the backlight settings of the display screen may be dynamically changed based on changes in the ambient light. To offset the change in the backlight settings, the display pipeline may be configured to change the color intensity in the frames.

In one embodiment, a virtual channel for the auxiliary channel of a display interface may be used to send backlight commands which are synchronized with frame updates. Accordingly, a change in the ambient light which occurs during the display of a first frame may cause the backlight settings to be updated at the start of a second frame being displayed, wherein the second frame is subsequent to the first frame in the video sequence being displayed.

These and other features and advantages will become apparent to those of ordinary skill in the art in view of the following detailed descriptions of the approaches presented herein.

BRIEF DESCRIPTION OF THE DRAWINGS

The above and further advantages of the methods and mechanisms may be better understood by referring to the following description in conjunction with the accompanying drawings, in which.

DETAILED DESCRIPTION OF EMBODIMENTS

Figure 1:
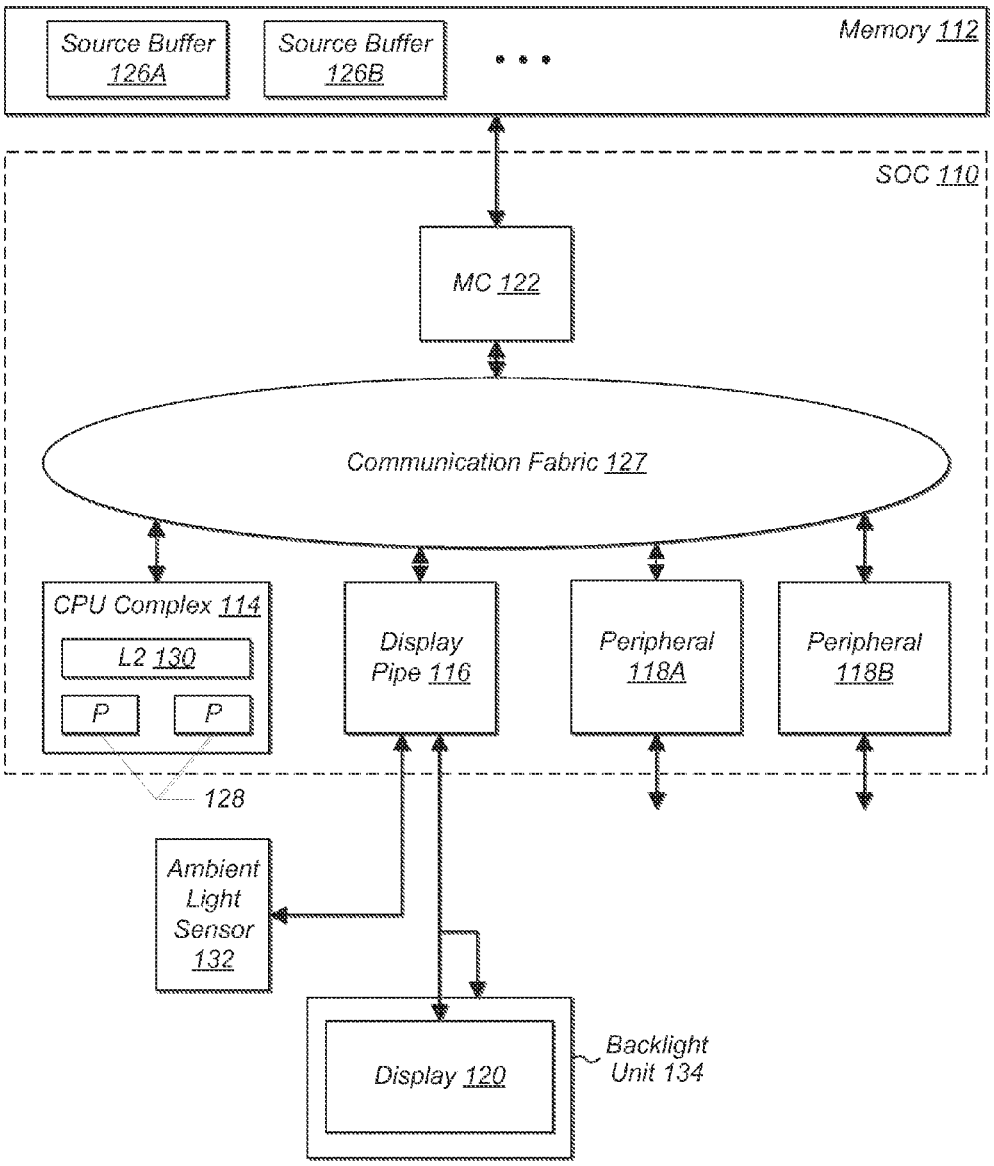
FIG. 1 is a block diagram illustrating one embodiment of a system on chip (SOC) coupled to a memory and one or more display devices.

In the following description, numerous specific details are set forth to provide a thorough understanding of the methods and mechanisms presented herein. However, one having ordinary skill in the art should recognize that the various embodiments may be practiced without these specific details. In some instances, well-known structures, components, signals, computer program instructions, and techniques have not been shown in detail to avoid obscuring the approaches described herein. It will be appreciated that for simplicity and clarity of illustration, elements shown in the figures have not necessarily been drawn to scale. For example, the dimensions of some of the elements may be exaggerated relative to other elements.

This specification includes references to "one embodiment". The appearance of the phrase "in one embodiment" in different contexts does not necessarily refer to the same embodiment. Particular features, structures, or characteristics may be combined in any suitable manner consistent with this disclosure. Furthermore, as used throughout this application, the word "may" is used in a permissive sense (i.e., meaning having the potential to), rather than the mandatory sense (i.e., meaning must). Similarly, the words "include", "including", and "includes" mean including, but not limited to.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "An apparatus comprising a display pipeline . . . ." Such a claim does not foreclose the apparatus from including additional components (e.g., a processor, a memory controller).

"Configured To." Various units, circuits, or other components may be described or claimed as "configured to" perform a task or tasks. In such contexts, "configured to" is used to connote structure by indicating that the units/circuits/components include structure (e.g., circuitry) that performs the task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. §112, paragraph (f), for that unit/circuit/component. Additionally, "configured to" can include generic structure (e.g., generic circuitry) that is manipulated by software and/or firmware (e.g., an FPGA or a general-purpose processor executing software) to operate in a manner that is capable of performing the task(s) at issue. "Configured to" may also include adapting a manufacturing process (e.g., a semiconductor fabrication facility) to fabricate devices (e.g., integrated circuits) that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

Referring now to FIG. 1, a block diagram of one embodiment of a system on chip (SOC) 110 is shown coupled to a memory 112, one or more display devices 120, and one or more ambient light sensors 132. Each ambient light sensor 132 may be configured to convert detected light levels into an electrical signal, such as a voltage, or into a digital representation of the detected light level. The detected light levels may then be used to control backlight levels for backlight unit 134 of display 120, wherein backlight levels are adjusted synchronously to frame updates for display 120. Backlight unit 134 may include a lighting source and a controller to control activation of the lighting source. Display pipe 116 may be configured to adjust the brightness of backlight unit 134 synchronously with frame updates to display 120, wherein the brightness is adjusted based on changes in the measured ambient light level.

In one embodiment, when sensor 132 detects that the host device is in a dark environment, a low backlight level may be utilized for display 120. As the amount of ambient light increases, the backlight level may increase as well. In one embodiment, the backlight level intensity of display 120 may be increased linearly as the amount of ambient light increases. In another embodiment, a lookup table may be utilized to store a set of backlight levels for a corresponding set of ambient light levels. In other embodiments, other suitable techniques may be utilized for adjusting the backlight level in response to changes in the ambient light level to provide an optimal viewing experience for the user and to minimize the power consumption of display 120.

In the illustrated embodiment, the components of the SOC 110 include a central processing unit (CPU) complex 114, a display pipe 116, peripheral components 118A-118B (more briefly, "peripherals"), a memory controller 122, and a communication fabric 127. The components 114, 116, 118A-118B, and 122 may all be coupled to the communication fabric 127. The memory controller 122 may be coupled to the memory 112 during use. Similarly, the display pipe 116 may be coupled to the display 120 during use. In the illustrated embodiment, the CPU complex 114 includes one or more processors 128 and a level two (L2) cache 130.

The display pipe 116 may include hardware to process one or more still images and/or one or more video sequences for display on the display 120. Generally, for each source still image or video sequence, the display pipe 116 may be configured to generate read memory operations to read the data representing the frame/video sequence from the memory 112 through the memory controller 122.

The display pipe 116 may be configured to perform any type of processing on the image data (still images, video sequences, etc.). In one embodiment, the display pipe 116 may be configured to scale still images and to dither, scale, and/or perform color space conversion on the frames of a video sequence. The display pipe 116 may be configured to blend the still image frames and the video sequence frames to produce output frames for display. The display pipe 116 may also be more generally referred to as a display control unit or a display controller. A display control unit may generally be any hardware configured to prepare a frame for display from one or more sources, such as still images and/or video sequences.

More particularly, the display pipe 116 may be configured to retrieve source frames from one or more source buffers 126A-126B stored in the memory 112, composite frames from the source buffers, and display the resulting frames on the display 120. Source buffers 126A and 126B are representative of any number of source buffers which may be stored in memory 112. Accordingly, display pipe 116 may be configured to read the multiple source buffers 126A-126B and composite the image data to generate the output frame. In some embodiments, rather than displaying the output frame, the resulting frame may be written back to memory 112.

The display 120 may be any sort of visual display device. The display 120 may include, for example, a touch screen style display used in mobile devices such as smart phones, tablets, etc. Display 120 may include a liquid crystal display (LCD), light emitting diode (LED), plasma, etc. The display may be integrated into a system including the SOC 110 (e.g. a smart phone or tablet) and/or may be a separately housed device such as a computer monitor, television, or other device. In another embodiment, display 120 may include a display coupled to the SOC 110 over a network (wired or wireless). Although not shown in FIG. 1, in some embodiments, SOC 110 may include a plurality of display pipelines coupled to a plurality of displays.

In some embodiments, the display 120 may be directly connected to the SOC 110 and may be controlled by the display pipe 116. That is, the display pipe 116 may include hardware (a "backend") that may provide various control/data signals to the display, including timing signals such as one or more clocks and/or the vertical blanking interval and horizontal blanking interval controls. The clocks may include the pixel clock indicating that a pixel is being transmitted. The data signals may include color signals such as red, green, and blue, for example. The display pipe 116 may control the display 120 in real-time, providing the data indicating the pixels to be displayed as the display is displaying the image indicated by the frame. The interface to such display 120 may be, for example, VGA, HDMI, digital video interface (DVI), a liquid crystal display (LCD) interface, a plasma interface, a cathode ray tube (CRT) interface, a DisplayPort™ interface, any proprietary display interface, etc.

In one embodiment, display pipe 116 may include a backlight calculation unit configured to control a backlight setting for backlight unit 134 of display 120. Display pipe 116 may also be configured to receive a measure of the ambient light from ambient light sensor 132. The measure of ambient light may be received asynchronously to a current frame being displayed by display pipe 116, and display pipe 116 may be configured to perform an update to backlight unit 134 synchronously with the start of the next frame being displayed rather than updating backlight unit 134 during the display of the current frame. In one embodiment, backlight unit 134 may be integrated into the housing of display 120. In some embodiments, ambient light sensor 132 may also be integrated into the housing of display 120.

The CPU complex 114 may include one or more CPU processors 128 that serve as the CPU of the SOC 110. The CPU of the system includes the processor(s) that execute the main control software of the system, such as an operating system. Generally, software executed by the CPU during use may control the other components of the system to realize the desired functionality of the system. The CPU processors 128 may also execute other software, such as application programs. The application programs may provide user functionality, and may rely on the operating system for lower level device control. Accordingly, the CPU processors 128 may also be referred to as application processors. The CPU complex 114 may further include other hardware such as the L2 cache 130 and/or an interface to the other components of the system (e.g., an interface to the communication fabric 127).

The peripherals 118A-118B may be any set of additional hardware functionality included in the SOC 110. For example, the peripherals 118A-118B may include video peripherals such as video encoder/decoders, image signal processors for image sensor data such as camera, scalers, rotators, blenders, graphics processing units, etc. The peripherals 118A-118B may include audio peripherals such as microphones, speakers, interfaces to microphones and speakers, audio processors, digital signal processors, mixers, etc. The peripherals 118A-118B may include interface controllers for various interfaces external to the SOC 110 including interfaces such as Universal Serial Bus (USB), peripheral component interconnect (PCI) including PCI Express (PCIe), serial and parallel ports, etc. The peripherals 118A-118B may include networking peripherals such as media access controllers (MACs). Any set of hardware may be included.

The memory controller 122 may generally include the circuitry for receiving memory operations from the other components of the SOC 110 and for accessing the memory 112 to complete the memory operations. The memory controller 122 may be configured to access any type of memory 112. For example, the memory 112 may be static random access memory (SRAM), dynamic RAM (DRAM) such as synchronous DRAM (SDRAM) including double data rate (DDR, DDR2, DDR3, etc.) DRAM. Low power/mobile versions of the DDR DRAM may be supported (e.g. LPDDR, mDDR, etc.). The memory controller 122 may include various queues for buffering memory operations, data for the operations, etc., and the circuitry to sequence the operations and access the memory 112 according to the interface defined for the memory 112.

The communication fabric 127 may be any communication interconnect and protocol for communicating among the components of the SOC 110. The communication fabric 127 may be bus-based, including shared bus configurations, cross bar configurations, and hierarchical buses with bridges. The communication fabric 127 may also be packet-based, and may be hierarchical with bridges, cross bar, point-to-point, or other interconnects.

It is noted that the number of components of the SOC 110 (and the number of subcomponents for those shown in FIG. 1, such as within the CPU complex 114) may vary from embodiment to embodiment. There may be more or fewer of each component/subcomponent than the number shown in FIG. 1. It is also noted that SOC 110 may include many other components not shown in FIG. 1. In various embodiments, SOC 110 may also be referred to as an integrated circuit (IC), an application specific integrated circuit (ASIC), or an apparatus.

Figure 2:
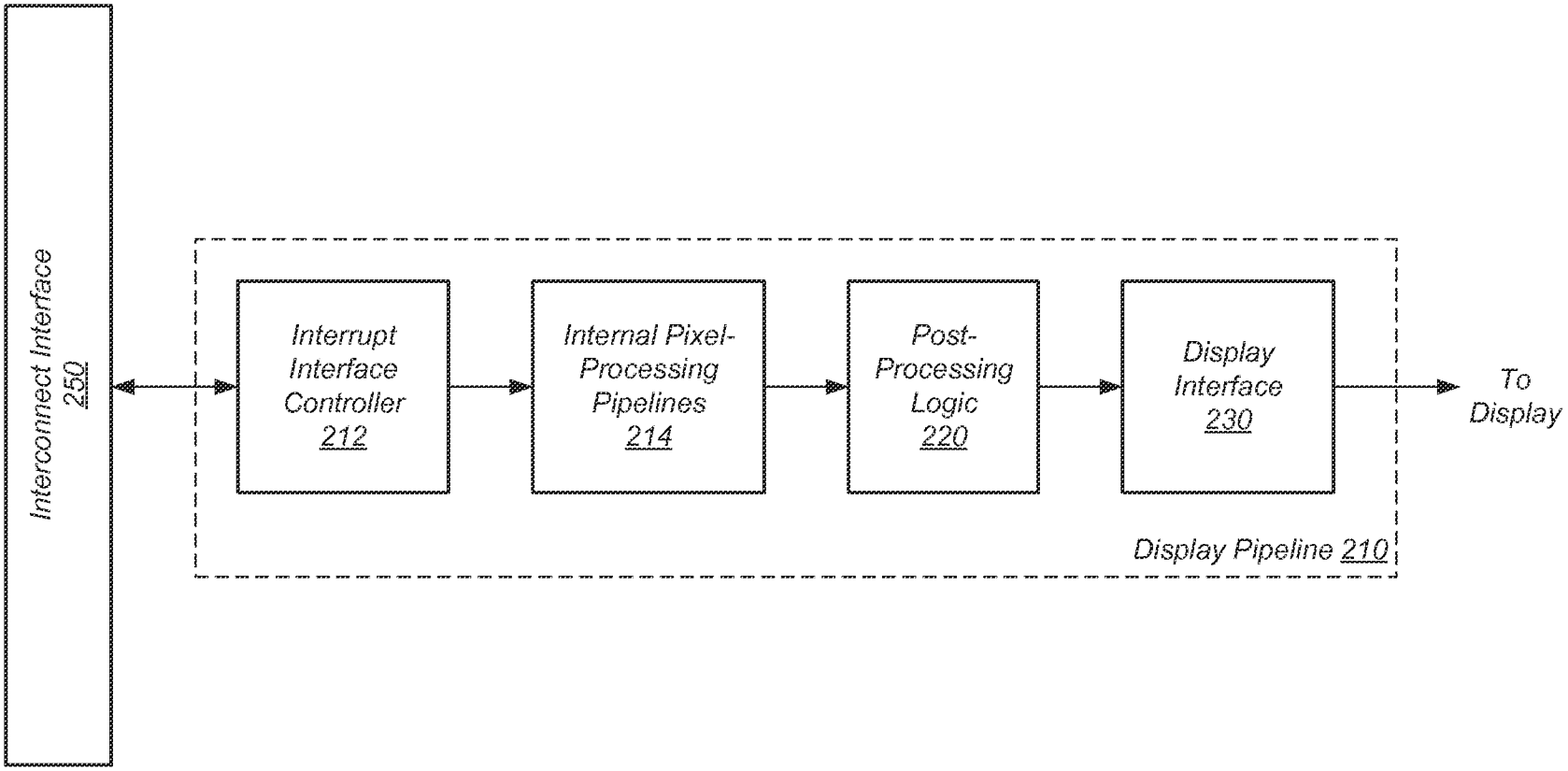
FIG. 2 is a generalized block diagram of one embodiment of a display pipeline for use in a SoC.

Turning now to FIG. 2, a generalized block diagram of one embodiment of a display pipeline for use in a SoC is shown. Although one display pipeline is shown, in other embodiments, the host SOC (e.g., SOC 110) may include multiple display pipelines. Generally speaking, display pipeline 210 may be configured to process a source image and send rendered graphical information to a display (not shown).

Display pipeline 210 may be coupled to interconnect interface 250 which may include multiplexers and control logic for routing signals and packets between the display pipeline 210 and a top-level fabric. The interconnect interface 250 may correspond to communication fabric 127 of FIG. 1. Display pipeline 210 may include interrupt interface controller 212. Interrupt interface controller 212 may include logic to expand a number of sources or external devices to generate interrupts to be presented to the internal pixel-processing pipelines 214. The controller 212 may provide encoding schemes, registers for storing interrupt vector addresses, and control logic for checking, enabling, and acknowledging interrupts. The number of interrupts and a selected protocol may be configurable.

Display pipeline 210 may include one or more internal pixel-processing pipelines 214. The internal pixel-processing pipelines 214 may include one or more ARGB (Alpha, Red, Green, Blue) pipelines for processing and displaying user interface (UI) layers. The internal pixel-processing pipelines 214 may also include one or more pipelines for processing and displaying video content such as YUV content. In some embodiments, internal pixel-processing pipelines 214 may include blending circuitry for blending graphical information before sending the information as output to post-processing logic 220.

A layer may refer to a presentation layer. A presentation layer may consist of multiple software components used to define one or more images to present to a user. The UI layer may include components for at least managing visual layouts and styles and organizing browses, searches, and displayed data. The presentation layer may interact with process components for orchestrating user interactions and also with the business or application layer and the data access layer to form an overall solution. The YUV content is a type of video signal that consists of three separate signals. One signal is for luminance or brightness. Two other signals are for chrominance or colors. The YUV content may replace the traditional composite video signal. The MPEG-2 encoding system in the DVD format uses YUV content. The internal pixel-processing pipelines 214 may handle the rendering of the YUV content.

The display pipeline 210 may include post-processing logic 220. The post-processing logic 220 may be used for color management, ambient-adaptive pixel (AAP) modification, dynamic backlight control (DPB), panel gamma correction, and dither. The display interface 230 may handle the protocol for communicating with the display. For example, in one embodiment, a DisplayPort interface may be used. Alternatively, the Mobile Industry Processor Interface (MIPI) Display Serial Interface (DSI) specification or a 4-lane Embedded Display Port (eDP) specification may be used. It is noted that the post-processing logic and display interface may be referred to as the display backend.

Figure 3:
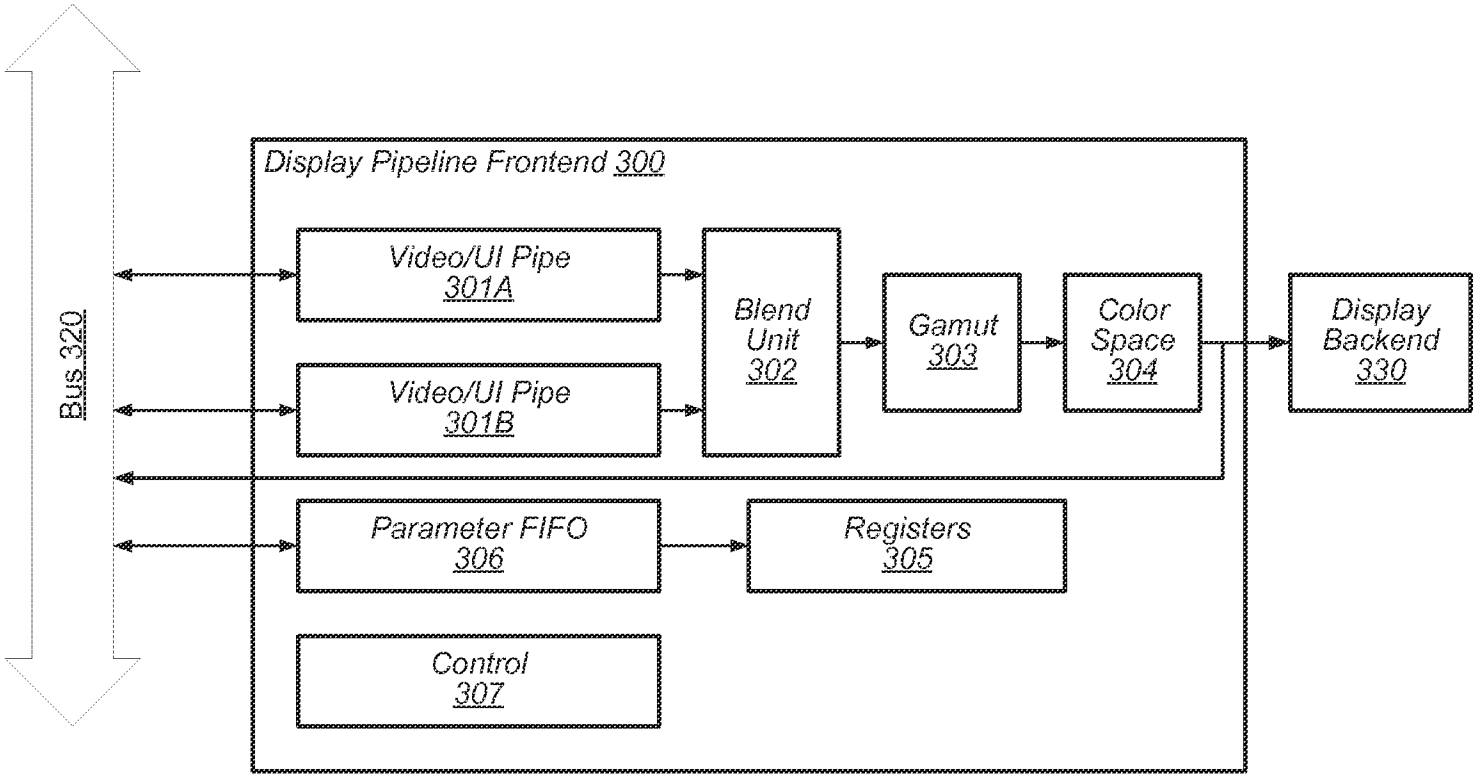
FIG. 3 is a block diagram illustrating one embodiment of a display pipeline frontend.

Referring now to FIG. 3, a block diagram of one embodiment of a display pipeline frontend 300 is shown. Display pipeline frontend 300 may represent the frontend portion of display pipe 116 included in SOC 110 in FIG. 1. Display pipeline frontend 300 may be coupled to a system bus 320 and to a display backend 330. In some embodiments, display backend 330 may directly interface to the display to display pixels generated by display pipeline frontend 300. Display pipeline frontend 300 may include functional sub-blocks such as one or more video/user interface (UI) pipelines 301A-B, blend unit 302, gamut adjustment block 303, color space converter 304, registers 305, parameter First-In First-Out buffer (FIFO) 306, and control unit 307. Display pipeline frontend 300 may also include other components which are not shown in FIG. 3 to avoid cluttering the figure.

System bus 320, in some embodiments, may correspond to communication fabric 127 from FIG. 1. System bus 320 couples various functional blocks such that the functional blocks may pass data between one another. Display pipeline frontend 300 may be coupled to system bus 320 in order to receive source video frame data for processing. In some embodiments, display pipeline frontend 300 may also send processed video frames to other functional blocks and/or memory that may also be coupled to system bus 320.

The display pipeline frontend 300 may include one or more video/UI pipelines 301A-B, each of which may be a video and/or user interface (UI) pipeline depending on the embodiment. It is noted that the terms "video/UI pipeline" and "pixel processing pipeline" may be used interchangeably herein. In other embodiments, display pipeline frontend 300 may have one or more dedicated video pipelines and/or one or more dedicated UI pipelines. Each video/UI pipeline 301 may fetch a source video or image frame (or a portion thereof) from a buffer coupled to system bus 320. The buffered video or image frame may reside in a system memory such as, for example, system memory 112 from FIG. 1. Each video/UI pipeline 301 may fetch a distinct source image and may process the source image in various ways, including, but not limited to, format conversion (e.g., YCbCr to ARGB), image scaling, and dithering. In some embodiments, each video/UI pipeline may process one pixel at a time, in a specific order from the source frame, outputting a stream of pixel data, and maintaining the same order as pixel data passes through.

Control unit 307 may, in various embodiments, be configured to arbitrate read requests to fetch data from memory from video/UI pipelines 301A-B. In some embodiments, the read requests may point to a virtual address. A memory management unit (not shown) may convert the virtual address to a physical address in memory prior to the requests being presented to the memory. In some embodiments, control unit 307 may include a dedicated state machine or sequential logic circuit. A general purpose processor executing program instructions stored in memory may, in other embodiments, be employed to perform the functions of control unit 307.

Blending unit 302 may receive a pixel stream from one or more of video/UI pipelines 301A-B. If only one pixel stream is received, blending unit 302 may simply pass the stream through to the next sub-block. However, if more than one pixel stream is received, blending unit 302 may blend the pixel colors together to create an image to be displayed. In various embodiments, blending unit 302 may be used to transition from one image to another or to display a notification window on top of an active application window. For example, a top layer video frame for a notification, such as, for a calendar reminder, may need to appear on top of, i.e., as a primary element in the display, despite a different application, an internet browser window for example. The calendar reminder may comprise some transparent or semi-transparent elements in which the browser window may be at least partially visible, which may require blending unit 302 to adjust the appearance of the browser window based on the color and transparency of the calendar reminder. The output of blending unit 302 may be a single pixel stream composite of the one or more input pixel streams.

The output of blending unit 302 may be sent to gamut adjustment unit 303. Gamut adjustment 303 may adjust the color mapping of the output of blending unit 302 to better match the available color of the intended target display. The output of gamut adjustment unit 303 may be sent to color space converter 304. Color space converter 304 may take the pixel stream output from gamut adjustment unit 303 and convert it to a new color space. Color space converter 304 may then send the pixel stream to display back end 330 or back onto system bus 320. In other embodiments, the pixel stream may be sent to other target destinations. For example, the pixel stream may be sent to a network interface for example. In some embodiments, a new color space may be chosen based on the mix of colors after blending and gamut corrections have been applied. In further embodiments, the color space may be changed based on the intended target display.

Display backend 330 may control the display to display the pixels generated by display pipeline frontend 300. Display backend 330 may read pixels at a regular rate from an output FIFO (not shown) of display pipeline frontend 300 according to a pixel clock. The rate may depend on the resolution of the display as well as the refresh rate of the display. For example, a display having a resolution of N×M and a refresh rate of R frames per second may have a pixel clock frequency based on N×M×R.

Display backend 330 may receive processed image data as each pixel is processed by display pipeline frontend 300. Display backend 330 may provide final processing to the image data before each video frame is displayed. In some embodiments, display back end may include ambient-adaptive pixel (AAP) modification, dynamic backlight control (DPB), display panel gamma correction, and dithering specific to an electronic display coupled to display backend 330.

The parameters that display pipeline frontend 300 uses to control how the various sub-blocks manipulate the video frame may be stored in control registers 305. These registers may include, but not limited to, setting input and output frame sizes, setting input and output pixel formats, location of the source frames, and destination of the output (display back end 330 or system bus 320). Control registers 305 may be loaded by parameter FIFO 306.

Parameter FIFO 306 may be loaded by a host processor, a direct memory access unit, a graphics processing unit, or any other suitable processor within the computing system. In other embodiments, parameter FIFO 306 may directly fetch values from a system memory, such as, for example, system memory 112 in FIG. 1. Parameter FIFO 306 may be configured to update control registers 305 of display processor 300 before each source video frame is fetched. In some embodiments, parameter FIFO may update all control registers 305 for each frame. In other embodiments, parameter FIFO may be configured to update subsets of control registers 305 including all or none for each frame. A FIFO as used and described herein, may refer to a memory storage buffer in which data stored in the buffer is read in the same order it was written. A FIFO may be comprised of RAM or registers and may utilize pointers to the first and last entries in the FIFO.

It is noted that the display pipeline frontend 300 illustrated in FIG. 3 is merely an example. In other embodiments, different functional blocks and different configurations of functional blocks may be possible depending on the specific application for which the display pipeline is intended. For example, more than two video/UI pipelines may be included within a display pipeline in other embodiments.

Figure 4:
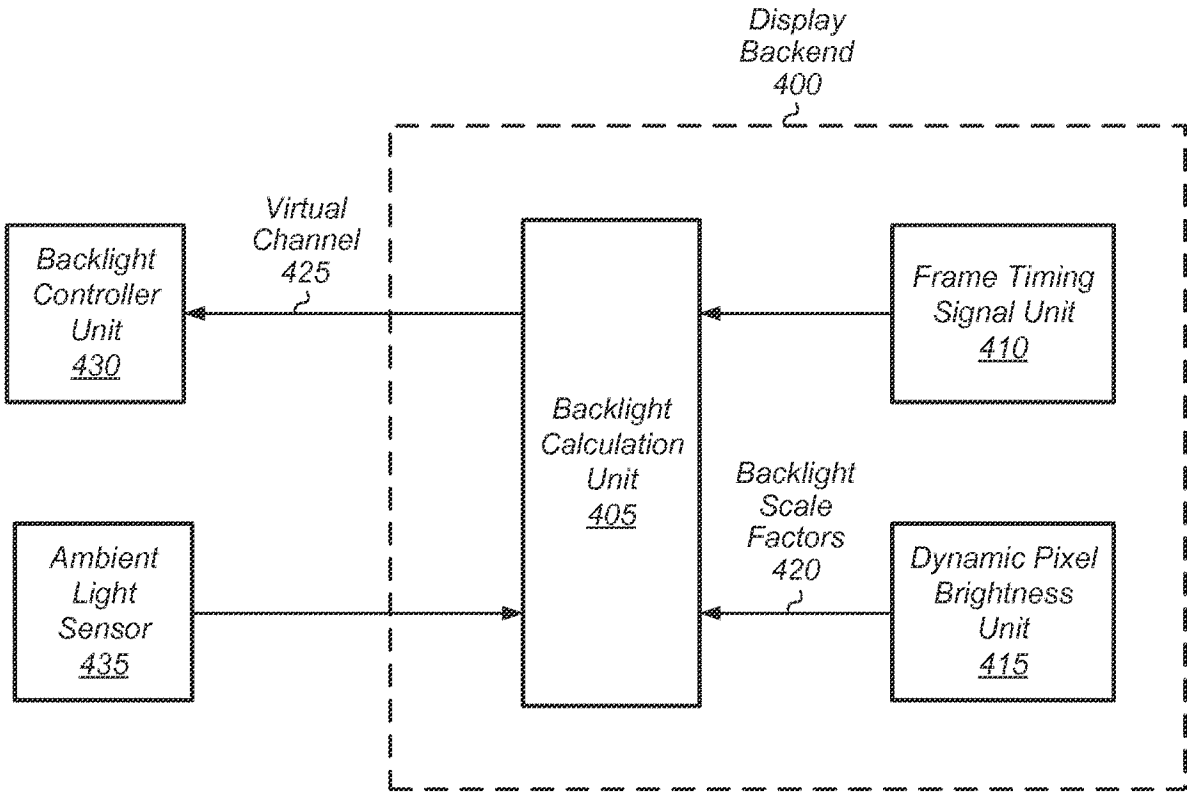
FIG. 4 is a block diagram illustrating one embodiment of a portion of a display backend, backlight controller unit, and ambient light sensor.

Turning now to FIG. 4, a block diagram of one embodiment of a portion of a display backend, backlight controller unit, and ambient light sensor are shown. Display backend 400 may include frame timing signal unit 410, dynamic pixel brightness unit 415, and backlight calculation unit 405. Backlight calculation unit 405 may be coupled to backlight controller unit 430 and to ambient light sensor 435. It is noted that display backend 400 may also include additional logic which is not shown in FIG. 4 to avoid obscuring the figure.

Backlight calculation unit 405 may be configured to receive backlight scale factors 420 from dynamic pixel brightness unit 415. In some embodiments, backlight scale factors 420 may be programmable by a user. Ambient light sensor 435 may be configured to detect and measure the brightness of the ambient light, which may change as the lighting conditions in the environment of the host device change. Ambient light sensor 435 is representative of any number of sensors which may be coupled to backlight calculation unit 405.

Backlight calculation unit 405 may be configured to receive an ambient light value from one or more ambient light sensor(s) 435. The value received by backlight calculation unit 405 from each ambient light sensor 435 may be received asynchronously with the respect to the driving of frames to the display (not shown). In one embodiment, backlight calculation unit 405 may query ambient light sensor 435 for a new ambient light value. In another embodiment, ambient light sensor 435 may determine when to send a new ambient light value to backlight calculation unit 405, such as on a set periodic schedule or based on detecting a change in the ambient light.

Backlight controller unit 430 may be coupled to the backlight module (not shown) of the display (not shown), with the backlight module controlling the amount of backlight generated during use of the display. Frame timing signal unit 410 may be configured to generate one or more signals synchronized to the frames being displayed and to convey these signals to backlight calculation unit 405 so that updates to the backlight settings are frame synchronized. The final backlight power level value may be calculated by backlight calculation unit 405, and this value may be conveyed from backlight calculation unit 405 to backlight controller unit 430 via virtual channel 425 based on timing signals received from frame timing signal unit 410. In some embodiments, the backlight module may be powered using a pulse width modulation (PWM) signal, and backlight calculation unit 405 may calculate a duty cycle of the PWM signal which may be conveyed to the backlight controller unit 430.

Figure 5:
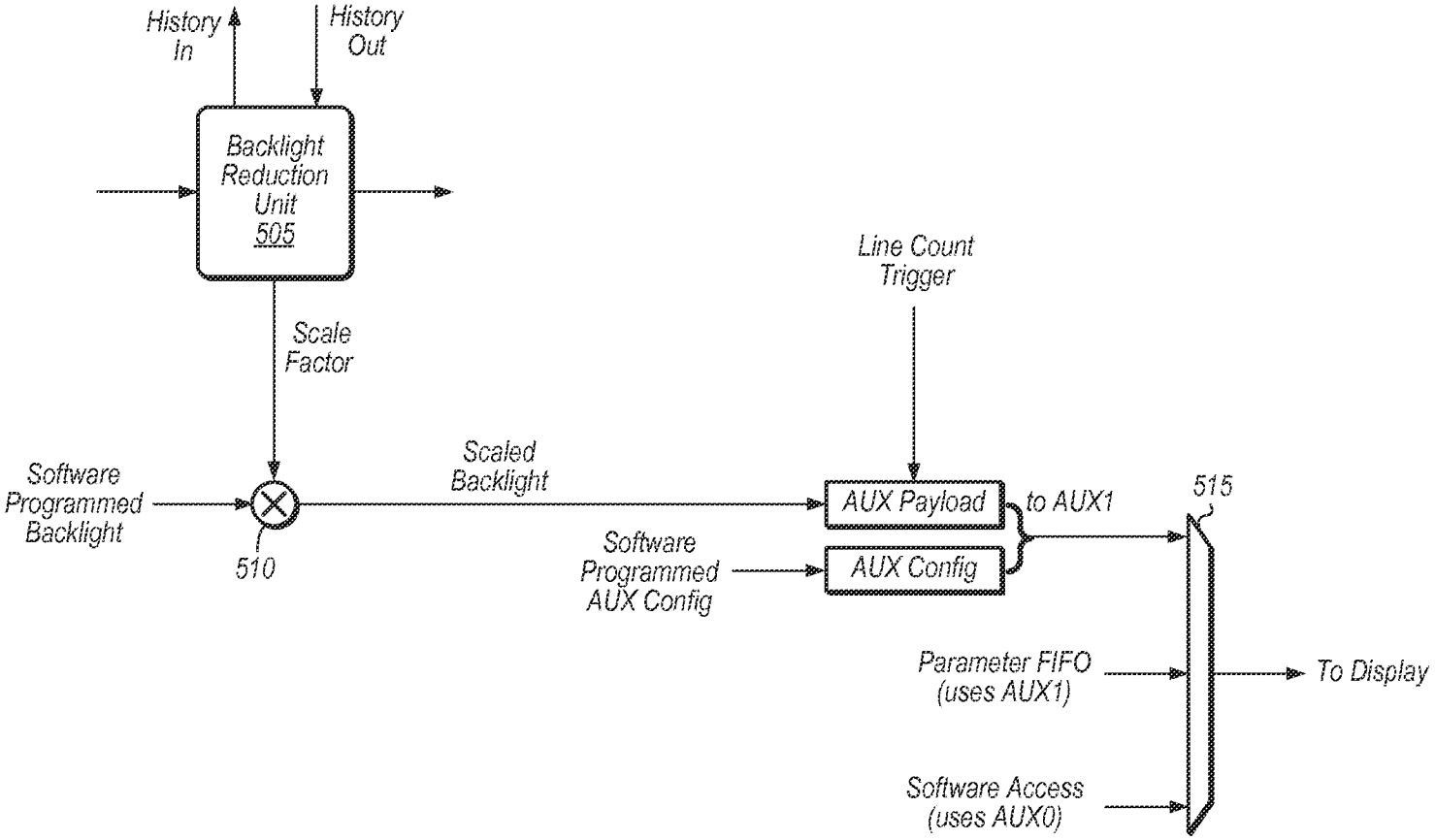
FIG. 5 is a block diagram illustrating another embodiment of a portion of a display backend.

Referring to FIG. 5, a block diagram of another embodiment of a portion of a display backend is shown. The circuitry shown in FIG. 5 may be located within a display backend (e.g., display backend 330 of FIG. 3) and may be configured to provide backlight control information and configuration data to a display via a display interface. In one embodiment, the display interface may be a DisplayPort interface. DisplayPort is a digital multimedia interface developed by the Video Electronics Standards Association (VESA). DisplayPort supports transmitting video, audio, and data signals between a source device and a sink device. In other embodiments, the display interface may utilize other types of interfaces.

A software programmable backlight value may be received by the circuitry of the display backend via software. Multiplier 510 may be configured to multiply this programmable backlight value by the scale factor generated by backlight reduction unit 505. It is noted that in one embodiment, multiplier 510 may be a hardware-dedicated multiplier circuit configured to perform multiplication in hardware rather than relying on a multiplication operation being performed in software. Backlight reduction unit 505 may receive the indication of ambient light from an ambient light sensor (not shown) and use this indication of ambient light to generate the scale factor which is conveyed to multiplier 510. Backlight reduction unit 505 may also be configured to receive and convey historical scale factor and ambient light settings to the other circuitry of the display pipeline.

The scaled backlight output from multiplier 510 may be conveyed to an 'AUX payload' register and then clocked out of the register using a line count trigger. The scaled backlight output may then be conveyed to one of the auxiliary inputs to the display interface via multiplexer (mux) 515. The line count trigger may be generated based on the line count of the current frame being displayed on the display, such that when the end of the current frame is reached and the line count is at its maximum value, the scaled backlight will be triggered out of the 'AUX payload' register to the display interface via mux 515. In other embodiments, other suitable techniques for triggering when the scaled backlight value is conveyed to the display so that it is synchronized to a frame boundary may be utilized.

Other configuration commands may be sent to the display via the output from mux 515. For example, software programmed auxiliary configuration data may utilize the auxiliary '1' port via mux 515. Also, parameter FIFO data may utilize the auxiliary '1' port via mux 515 and software access may utilize the auxiliary '0' port via mux 515.

Figure 6:
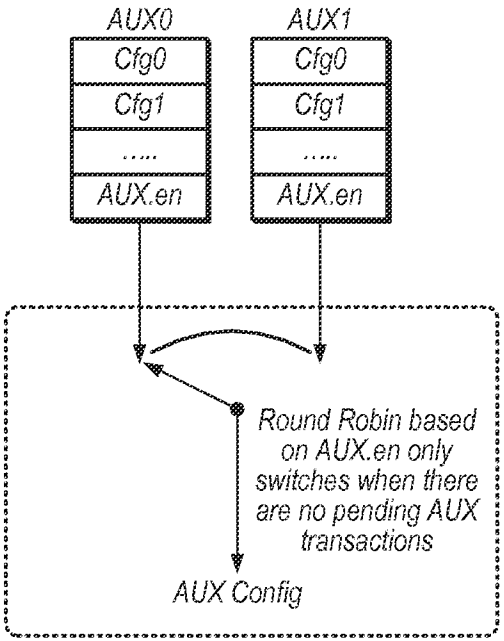
FIG. 6 is a block diagram illustrating one embodiment of a display interface.

Turning now to FIG. 6, a block diagram of one embodiment of a display interface is shown. In one embodiment, there may be only one auxiliary channel on the display interface. The receiver side of the display interface may consolidate two auxiliary (or AUX) channels onto the single AUX channel of the display interface. Accordingly, the second AUX channel (or AUX1) may be mapped into one AUX channel address space as seen by the display pipeline. In one embodiment, the access to the first AUX channel (or AUX0) may start at address offset 0 while the access to the second AUX channel (or AUX1) may start at a programmable offset.

In one embodiment, there may be separate queues for the AUX0 and AUX1 channels. Each queue may store configuration data (i.e., Cfg0, Cfg1). In one embodiment, the queues may utilize a round robin selection based on AUX.en, such that the output only switches to the other AUX channel when there are no pending AUX transactions on the current AUX channel.

Figure 7:
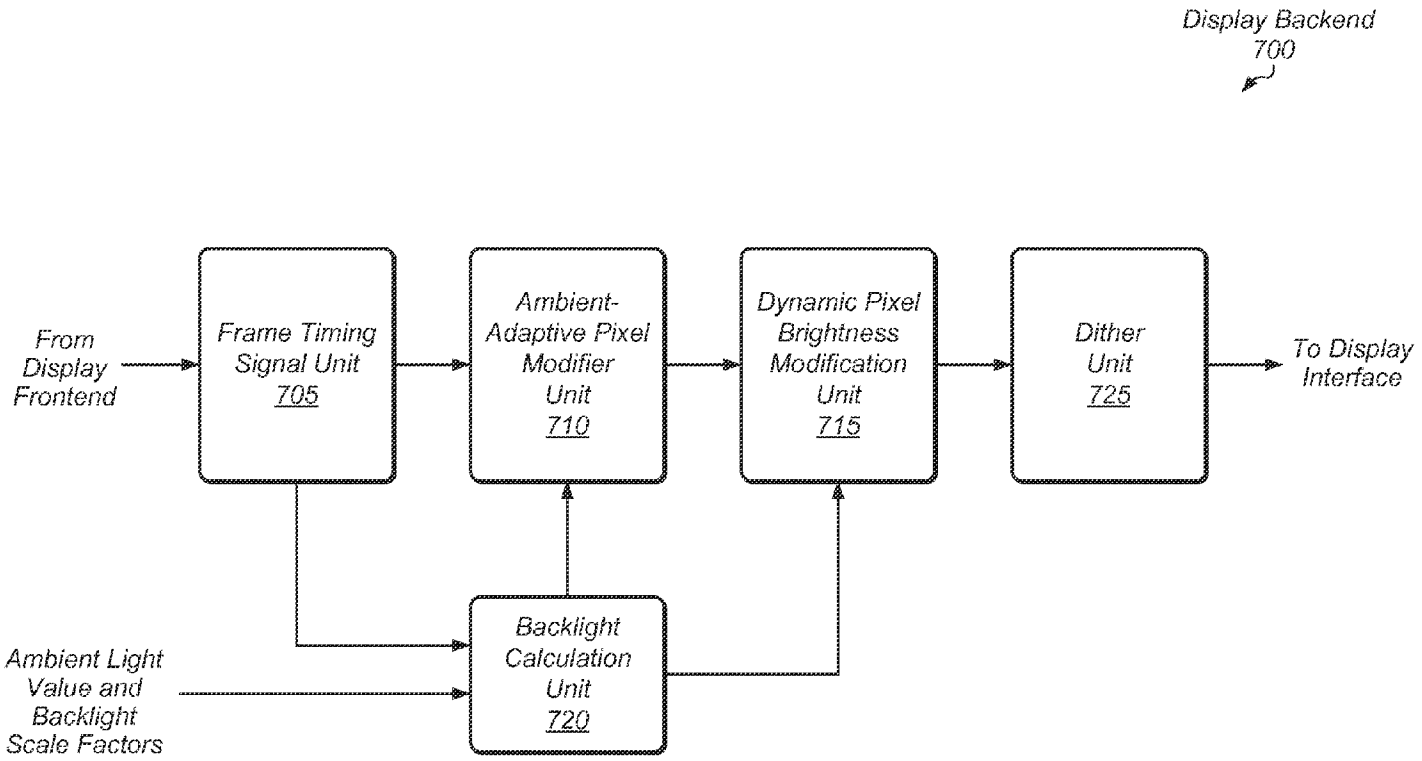
FIG. 7 is a block diagram of another embodiment of a portion of display backend.

Referring now to FIG. 7, a block diagram of another embodiment of a portion of display backend 700 is shown. Display backend 700 includes several units which are configured to process pixel data received from a display frontend (not shown) (e.g., display frontend 300 of FIG. 3) and convey the processed pixel data to a display interface (not shown). It is noted that display backend 700 may also include other logic which is not shown in FIG. 7 to avoid obscuring the figure. For example, display backend 700 may also include the logic shown in display backend 400 of FIG. 4.

Frame timing signal unit 705 may be configured to generate frame timing signals (e.g., vertical blanking signal, vertical active signal) and convey these frame timing signals to the other units of display backend 700 as well as to one or more other units not shown in FIG. 7. Ambient-adaptive pixel modifier unit 710 may be configured to process pixels based on the amount of ambient light and the display brightness (e.g., backlight power level) being generated for the backlight unit of the display. Backlight calculation unit 720 may be configured to generate the backlight power level based on the ambient light value and one or more backlight scale factors. Backlight calculation unit 720 may be configured to convey the backlight power level to ambient-adaptive pixel modifier unit 710, dynamic pixel brightness modification unit 715, and the backlight controller (not shown) synchronously to the next frame being displayed based on the timing signals received via frame timing signal unit 705.

When the display backend 700 updates the backlight power level synchronously to the next frame to be displayed, dynamic pixel brightness modification unit 715 may be configured to synchronously update the color intensity of the next frame being displayed. For example, if the backlight power level is reduced, the color intensity of the pixels of the next frame may be increased corresponding to the reduction in the backlight power level. Dither unit 725 may be configured to apply dithering to the pixel data and then convey the dithered pixel data to the display interface.

Figure 8:
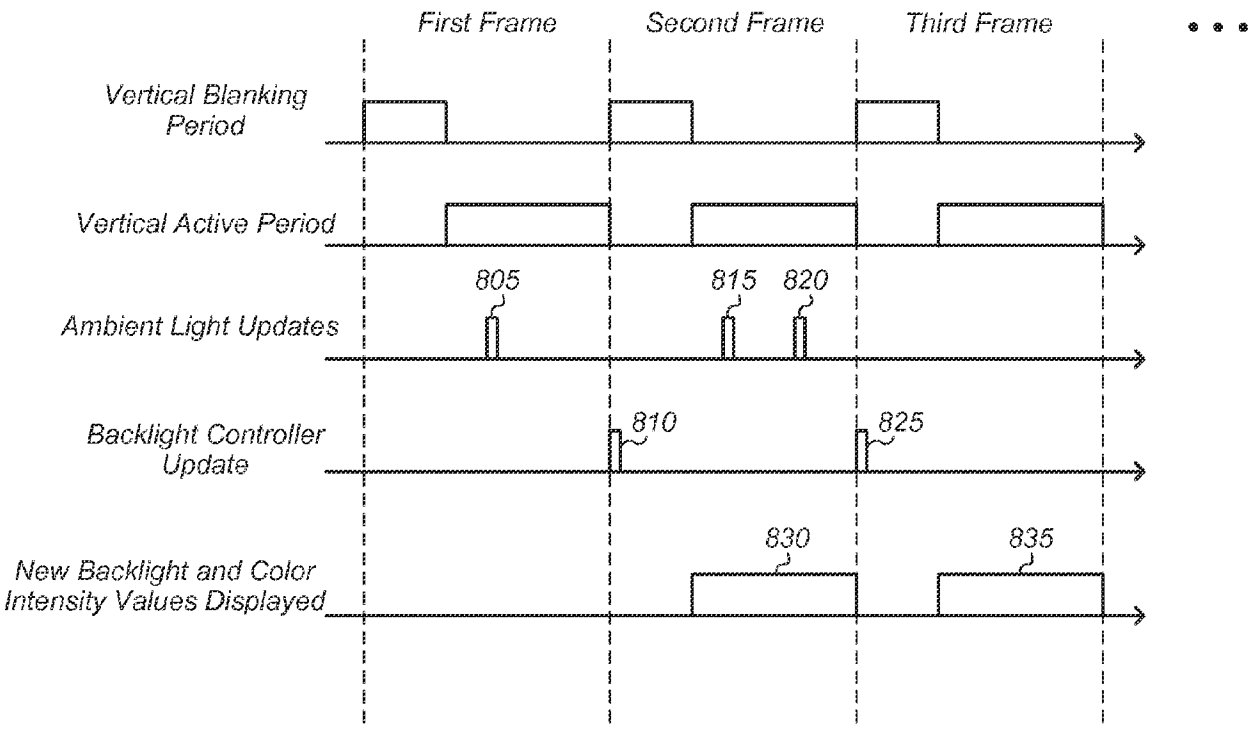
FIG. 8 is a timing diagram illustrating one embodiment for synchronizing backlight updates to a frame updates.

Turning now to FIG. 8, one embodiment of a timing diagram for synchronizing backlight power level updates to frame updates is shown. The timing for three frames being displayed to a display with a backlight in accordance with one embodiment is shown in FIG. 8. It is noted that the period of time of a frame prior to pixels being actively driven to the display may be referred to as the "vertical blanking period". During this period of time, no pixels are being driven to the display, while portions of the display pipeline circuitry may be making preparations for the frame about to be displayed. Also during the vertical blanking period, other portions of the display pipeline circuitry may be clock-gated to reduce power consumption. In one embodiment, the backlight power level (or other equivalent display brightness metric) may be sent to the display interface at the start of the vertical blanking period. In another embodiment, the backlight power level may be sent to the display interface at another point in time in the vertical blanking period so that the backlight power level is received before the start of the vertical active period.

As shown, an update to the ambient light is detected by the ambient light sensor during the first frame. This update during the first frame is shown as pulse 805 in the row labeled "ambient light updates" of the timing diagram. As a result of the asynchronous ambient light update 805, the backlight calculation unit (e.g., backlight calculation unit 405 of FIG. 4) may calculate a new backlight power level and then send a corresponding backlight controller update 810 to the backlight unit of the display at the start of the next vertical blanking period. This update 810 to the backlight controller may include one or more backlight commands and may cause the backlight to operate at an updated backlight power level. In addition, the backlight calculation unit may send an update to a dynamic pixel brightness modification unit (e.g., dynamic pixel brightness modification unit 715 of FIG. 7) to cause new color intensity values to be generated during the vertical active period of the second frame, which is shown as pulse 830 in the second frame of FIG. 8.

Similarly, two updates 815 and 820 to the ambient light are shown as being detected by the ambient light sensor in the second frame. It is noted that the ambient light may change at any point in time as lighting conditions of the host device change. If multiple updates are received in a given frame, only the last update may be used to adjust the backlight and color intensity to offset the detected change in the ambient light. Accordingly, ambient light update 820 may be used to generate a corresponding change in the backlight power level and color intensity of the third frame, and these changes may be sent to the backlight unit and display backend. As a result of ambient light update 820, update 825 may be generated by the backlight calculation unit during the start of the vertical blanking period of the third frame. Accordingly, new backlight and color intensity values 835 may be displayed during the vertical active period of the third frame to correspond to the backlight controller update 825. In this example, ambient light update 815 may be ignored since a subsequent ambient light update 820 was generated during the second frame.

In one embodiment, the host device may have multiple ambient light sensors. Each ambient light sensor may send a value of the ambient light to a backlight calculation unit (e.g., backlight calculation unit 405 of FIG. 4), and the backlight calculation unit may use a plurality of ambient light values to generate a corresponding backlight power level with which to drive the backlight unit of the display. For example, the backlight calculation unit may calculate the average of a plurality of ambient light values and use the average value to generate a corresponding backlight power level. In one embodiment, each ambient light sensor may be coupled to the backlight calculation unit over a single wire or bus, and each ambient light sensor may be assigned a different interval of time within the frame period for reporting its ambient light value to the backlight calculation unit to prevent different sensors from transmitting values at the same time.

In one embodiment, each ambient light sensor may send an ambient light value once per frame period, and the value may be sent early enough to allow the backlight calculation unit enough time to calculate a new backlight power level and update the backlight unit of the display for the next frame being displayed. In another embodiment, each ambient light sensor may send ambient light values only when these values change by an amount which is greater than a programmable threshold. Therefore, in this embodiment, the ambient light sensors may not send a new ambient light value for a long period of time if the ambient light conditions of the host device stay within a tight range. In some embodiments, the mode in which the ambient light sensors operate may be programmable by the user or may change according to the display mode which is being used. For example, if the user is watching a video, the display may operate in a first mode with the ambient light sensors generating and reporting ambient light values at a first rate while if the user is browsing a webpage, the display may operate in a second mode with the ambient light generating and reporting ambient light values at a second rate, wherein the second rate is different from the first rate.

Alternatively, the backlight calculation unit may be configured to query the one or more ambient light sensors on a regular interval. For example, the backlight calculation unit may query the sensors once per frame at a point in time within the frame which will allow the display pipeline enough time to process any change in the ambient light and make a corresponding change in the backlight power level and the color intensity such that these changes can be introduced during the next frame to be displayed.

Figure 9:
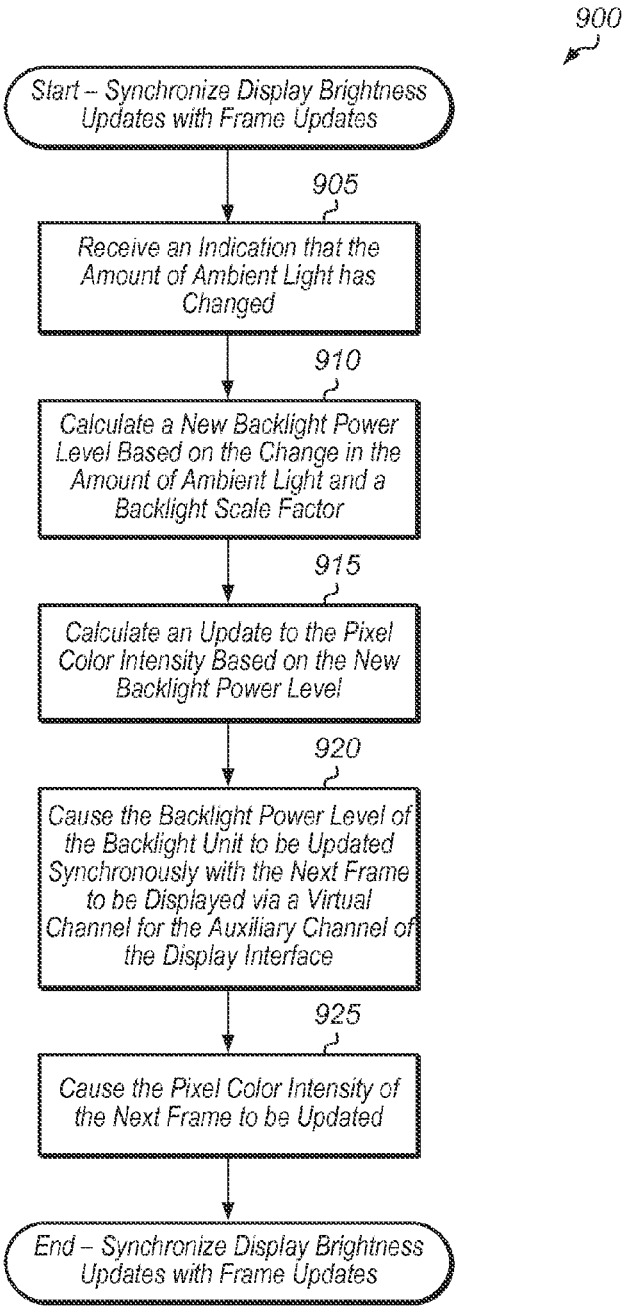
FIG. 9 is a generalized flow diagram illustrating one embodiment of a method for synchronizing backlight value updates to frame updates.

Referring now to FIG. 9, one embodiment of a method 900 for synchronizing display brightness updates with frame updates is shown. For purposes of discussion, the steps in this embodiment are shown in sequential order. It should be noted that in various embodiments of the method described below, one or more of the elements described may be performed concurrently, in a different order than shown, or may be omitted entirely. Other additional elements may also be performed as desired.

The display pipeline may receive an indication that the amount of ambient light has changed (block 905). This indication may be received asynchronously while a current frame is being displayed. In one embodiment, one or more ambient light sensors may measure the amount of ambient light and send the indication to the backlight calculation unit of the display pipeline. Then, the display pipeline may determine that the amount of ambient light has changed. In another embodiment, an ambient light sensor may detect a change in the ambient light and send an indication of this change to the display pipeline.

Next, the display pipeline may calculate a new backlight power level based on the change in the amount of ambient light and a backlight scale factor (block 910). In one embodiment, the backlight scale factor may be programmable by a user. Also, the display pipeline may calculate an update to the pixel color intensity based on the new backlight power level (block 915).

Next, the display pipeline may cause the backlight power level of the backlight unit to be updated synchronously with the next frame to be displayed via a virtual channel for the auxiliary channel of the display interface (block 920). Also, the display pipeline may cause the pixel color intensity of the next frame to be updated (block 925). In one embodiment, the updates to the backlight value and pixel color intensity may be triggered by a line counter reaching a value (i.e., last line of the current frame) indicating the end of the current frame has been reached. After block 925, method 900 may end.

Figure 10:
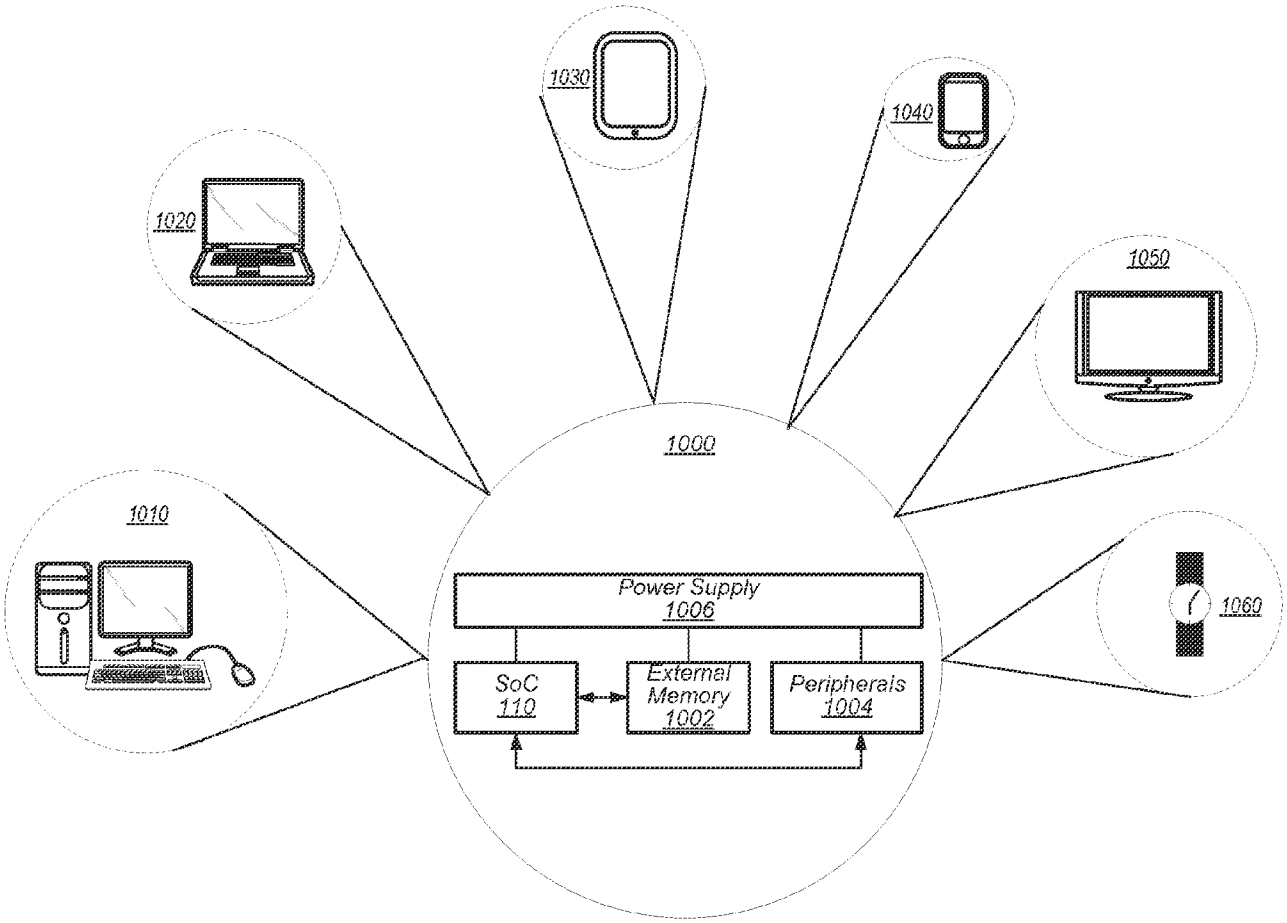
FIG. 10 is a block diagram of one embodiment of a system.

Referring next to FIG. 10, a block diagram of one embodiment of a system 1000 is shown. As shown, system 1000 may represent chip, circuitry, components, etc., of a desktop computer 1010, laptop computer 1020, tablet computer 1030, cell phone 1040, television 1050 (or set top box configured to be coupled to a television), wrist watch or other wearable item 1060, or otherwise. Other devices are possible and are contemplated. In the illustrated embodiment, the system 1000 includes at least one instance of SoC 110 (of FIG. 1) coupled to an external memory 1002.

SoC 110 is coupled to one or more peripherals 1004 and the external memory 1002. A power supply 1006 is also provided which supplies the supply voltages to SoC 110 as well as one or more supply voltages to the memory 1002 and/or the peripherals 1004. In various embodiments, power supply 1006 may represent a battery (e.g., a rechargeable battery in a smart phone, laptop or tablet computer). In some embodiments, more than one instance of SoC 110 may be included (and more than one external memory 1002 may be included as well).

The memory 1002 may be any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., and/or low power versions of the SDRAMs such as LPDDR2, etc.), RAMBUS DRAM (RDRAM), static RAM (SRAM), etc. One or more memory devices may be coupled onto a circuit board to form memory modules such as single inline memory modules (SIMMs), dual inline memory modules (DIMMs), etc. Alternatively, the devices may be mounted with SoC 110 in a chip-on-chip configuration, a package-on-package configuration, or a multi-chip module configuration.

The peripherals 1004 may include any desired circuitry, depending on the type of system 1000. For example, in one embodiment, peripherals 1004 may include devices for various types of wireless communication, such as wifi, Bluetooth, cellular, global positioning system, etc. The peripherals 1004 may also include additional storage, including RAM storage, solid state storage, or disk storage. The peripherals 1004 may include user interface devices such as a display screen, including touch display screens or multitouch display screens, keyboard or other input devices, microphones, speakers, etc.

In various embodiments, program instructions of a software application may be used to implement the methods and/or mechanisms previously described. The program instructions may describe the behavior of hardware in a high-level programming language, such as C. Alternatively, a hardware design language (HDL) may be used, such as Verilog. The program instructions may be stored on a non-transitory computer readable storage medium. Numerous types of storage media are available. The storage medium may be accessible by a computer during use to provide the program instructions and accompanying data to the computer for program execution. In some embodiments, a synthesis tool reads the program instructions in order to produce a netlist comprising a list of gates from a synthesis library.

It should be emphasized that the above-described embodiments are only non-limiting examples of implementations.

Numerous variations and modifications will become apparent to those skilled in the art once the above disclosure is fully appreciated. It is intended that the following claims be interpreted to embrace all such variations and modifications.

What is claimed is:

1. A system comprising:

one or more display devices; and a display pipeline in communication with the one or more display devices, wherein the display pipeline comprises:

a frame timing signal unit configured to generate one or more timing signals synchronized to frames being displayed on a display device of the one or more display devices;

circuitry configured to consolidate a first auxiliary input and a second auxiliary input different from the first auxiliary input onto a single auxiliary channel of a display interface;

an ambient light sensor configured to generate an indication of a change in a measured ambient light level, wherein the indication is generated asynchronously with a start of a current frame being displayed on the display device; and a backlight unit coupled to the frame timing signal unit and the ambient light sensor, wherein in response to receiving said indication, the backlight unit is configured to:

calculate an updated backlight level based at least in part on the indication; and send information corresponding to said updated backlight level to the display device via the first auxiliary input of the display interface, wherein said information is sent based at least in part on one or more timing signals received from the frame timing signal unit such that said updated backlight level is synchronized with a start of a next frame being displayed.

2. The system as recited in claim 1, wherein a brightness of the display device is updated by changing a backlight power level of the display device based on the information.

3. The system as recited in claim 2, wherein the backlight power level is based at least in part on a programmable backlight scale factor.

4. The system as recited in claim 2, wherein in response to detecting the information indicates the backlight power level is to be reduced at a start of the next frame, the display pipeline is further configured to increase a pixel color intensity of the next frame.

5. The system as recited in claim 2, wherein the change of the backlight power level is synchronized with a start of the next frame by triggering the change of the backlight power level when a line counter reaches a last line of the current frame being displayed.

6. The system as recited in claim 1, wherein to consolidate the first auxiliary input and the second auxiliary input onto the single auxiliary channel, the display pipeline is further configured to:

map the first auxiliary input to a first address space, wherein the first address space may be used to store one or more backlight commands; and map the second auxiliary input to a second address space different from the first address space; and multiplex the first auxiliary input and the second auxiliary input onto the single auxiliary channel.

7. The system as recited in claim 6, wherein to synchronize the start of the next frame being displayed with the display receiving the information, the display pipeline is further configured to select the first auxiliary input rather than the second auxiliary input for conveyance via the single auxiliary channel responsive to determining an end of the current frame is reached.

8. A method implemented by a display pipeline comprising:

generating, by a frame timing signal unit, one or more timing signals synchronized to frames being displayed on a display device of the one or more display devices;

consolidating, by circuitry, a first auxiliary input and a second auxiliary input different from the first auxiliary input onto a single auxiliary channel of a display interface;

generating, by an ambient light sensor, an indication of a change in a measured ambient light level, wherein the indication is generated asynchronously with a start of a current frame being displayed on the display device;

calculating, by a backlight unit, an updated backlight level based at least in part on the indication; and sending, by the backlight unit, information corresponding to said updated backlight level to the display device via the first auxiliary input of the display interface, wherein said information is sent based at least in part on one or more timing signals received from the frame timing signal unit such that said updated backlight level is synchronized with a start of a next frame being displayed.

9. The method as recited in claim 8, wherein a brightness of the given display device is updated by changing a backlight power level based on the received information.

10. The method as recited in claim 9, wherein the backlight power level is based at least in part on a programmable backlight scale factor.

11. The method as recited in claim 9, further comprising increasing a pixel color intensity of the next frame in response to detecting the information indicates the backlight power level is to be reduced at a start of the next frame.

12. The method as recited in claim 9, wherein the change of the backlight power level is synchronized with a start of the next frame by triggering the change of the backlight power level when a line counter reaches a last line of the current frame being displayed.

13. The method as recited in claim 8, wherein to consolidate the first auxiliary input and the second auxiliary input onto the single auxiliary channel, the method further comprises:

mapping the first auxiliary input to a first address space, wherein the first address space may be used to store one or more backlight commands;

mapping the second auxiliary input to a second address space different from the first address space; and multiplexing the first auxiliary input and the second auxiliary input onto the single auxiliary channel.

14. The method as recited in claim 13, wherein to synchronize the start of the next frame being displayed with the display receiving the information, the method comprises selecting the first auxiliary input rather than the second auxiliary input for conveyance via the single auxiliary channel responsive to determining an end of the current frame is reached.

15. A non-transitory computer readable storage medium comprising program instructions, wherein when executed by a processor, the program instructions are operable to:

generate, by a frame timing signal unit, one or more timing signals synchronized to frames being displayed on a display device of the one or more display devices;

consolidate, by circuitry, a first auxiliary input and a second auxiliary input different from the first auxiliary input onto a single auxiliary channel of a display interface;

generate an indication of a change in a measured ambient light level, wherein the indication is generated asynchronously with a start of a current frame being displayed on the display device;

calculate, by a backlight unit, an updated backlight level based at least in part on the indication; and send, by the backlight unit, information corresponding to said updated backlight level to the display device via the first auxiliary input of the display interface, wherein said information is sent based at least in part on one or more timing signals received from the frame timing signal unit such that said updated backlight level is synchronized with a start of a next frame being displayed.

16. The non-transitory computer readable storage medium as recited in claim 15, wherein a brightness of the given display device is updated by changing a backlight power level based on the received information.

17. The non-transitory computer readable storage medium as recited in claim 16, wherein the backlight power level is based at least in part on a programmable backlight scale factor.

18. The non-transitory computer readable storage medium as recited in claim 16, wherein the program instructions are further operable to increase a pixel color intensity of the next frame in response to detecting the information indicates the backlight power level is to be reduced at a start of the next frame.

19. The non-transitory computer readable storage medium as recited in claim 15, wherein to consolidate the first auxiliary input and the second auxiliary input onto the single auxiliary channel, the program instructions when executed by a processor are further operable to:

map the first auxiliary input to a first address space, wherein the first address space may be used to store one or more backlight commands;

map the second auxiliary input to a second address space different from the first address space; and multiplex the first auxiliary input and the second auxiliary input onto the single auxiliary channel.

20. The non-transitory computer readable storage medium as recited in claim 19, wherein to synchronize the start of the next frame being displayed with the display receiving the information, the program instructions are operable to select the first auxiliary input rather than the second auxiliary input for conveyance via the single auxiliary channel responsive to determining an end of the current frame is reached.

* * * * *